United States Patent [19]

Wollensak

[11] 4,341,482

[45] Jul. 27, 1982

[54] HOUSING ASSEMBLY FOR FLUID MARKING DEVICE

[75] Inventor: Daniel W. Wollensak, Elmhurst, Ill.

[73] Assignee: Sanford Research Company, Bellwood, Ill.

[21] Appl. No.: 189,053

[22] Filed: Sep. 22, 1980

[51] Int. Cl.[3] ..... B43K 15/00; B43K 8/00; B43K 3/00

[52] U.S. Cl. ..... 401/251; 285/330; 401/196; 401/199; 401/207; 401/209; 403/364

[58] Field of Search ..... 401/196, 198, 199, 207, 401/251, 212, 214, 202, 209, 216, 241; 285/330; 403/364

[56] References Cited

U.S. PATENT DOCUMENTS

| | | | |
|---|---|---|---|
| 322,457 | 7/1885 | Koch | 285/330 |
| 820,194 | 5/1906 | Hoffman | 403/364 X |
| 1,237,619 | 8/1917 | Craig | 401/251 |
| 3,171,196 | 3/1965 | Helitas . | |
| 3,230,574 | 1/1966 | Kershaw | 401/198 |
| 3,356,440 | 12/1967 | Darst . | |
| 3,544,229 | 12/1970 | Aoki et al. . | |
| 3,554,658 | 1/1971 | Malm et al. . | |
| 3,592,552 | 7/1971 | Malm . | |
| 3,659,953 | 5/1972 | Taylor . | |

FOREIGN PATENT DOCUMENTS

| | | |
|---|---|---|
| 1461598 | 1/1969 | Fed. Rep. of Germany . |
| 2555391 | 11/1976 | Fed. Rep. of Germany . |

*Primary Examiner*—Steven A. Bratlie

*Attorney, Agent, or Firm*—Wegner, McCord, Wood & Dalton

[57] ABSTRACT

A housing assembly for a writing instrument is provided comprising a long, hollow barrel member and a ferrule member assembled in end-to-end relationship to afford an inner chamber for a reservoir of marking fluid. A writing nib projects from the ferrule and extends into the reservoir.

The ferrule member and the barrel member have adjacent skirt portions in telescoping assembled relation, the skirt portions, when moved longitudinally one into the other, afford latching means, sealing means and means for constraining relative rotation between the assembled ferrule member and the barrel member, thereby providing a securely sealed and easily assembled housing for a writing instrumemt.

8 Claims, 5 Drawing Figures

HOUSING ASSEMBLY FOR FLUID MARKING DEVICE

BACKGROUND OF THE INVENTION

1. Field of the Invention

This invention relates to writing instruments and, more specifically, to a housing assembly for a writing instrument formed by mechanically uniting a ferrule member and a barrel member to provide an internal chamber for writing fluid.

2. Description of the Prior Art

Modern writing instruments of the type comprising a hollow barrel which holds a reservoir for writing fluid and a nib projecting through a ferrule for transporting fluid from the reservoir to a writing surface are well known. The nib is generally mounted in and projects from the ferrule which is attached to the barrel holding the fluid reservoir for the writing instrument. Such writing instruments are preferably made of inexpensive material, such as polypropylene, nylon or other plastic materials, so that the instruments are disposable and are discarded upon complete use of the writing fluid therein contained.

Conventionally, the barrel and ferrule of such writing instruments have been assembled by welding, by chemically bonding, by a press fit operation, or by screwing the ferrule to the barrel to enclose a previously inserted fluid reservoir in the capsular internal chamber. The ferrule generally has an end portion which is inserted into an open end of the barrel.

One popular method of forming such a housing assembly from a barrel and ferrule which is used in automatic production is known as spin welding. In the spin welding technique, the adjacent complementary portions of the ferrule and the barrel are each of mating circular cross section and of a size to be inserted one within the other.

To this end, the barrels are normally advanced in a row side-by-side on an assembly line. A fluid reservoir is inserted into each barrel and filled with ink (if not prefilled). The ferrule is then positioned in alignment with the barrel, and the end portion of the ferrule is inserted into the adjacent end portion of the barrel so that the surfaces of the end portions contact one another. The barrel or the ferrule is then rotated relative to the other at high speed. The frictional contact between the surfaces of the two end portions melts and fuses the plastic material of the adjacent surfaces of the ferrule and the barrel to unite the parts into a housing assembly for a writing instrument. This procedure may be effected by gripping and spinning the ferrule while the barrel is held stationary and in alignment with the ferrule.

After the spin welding operation, a nib is inserted through the bore of the nib holder at the exposed end of the ferrule and into contact with the fluid reservoir positioned within the housing assembly.

Although carefully supervised spin welding techniques have been satisfactory for production, they incorporate certain disadvantages. The ferrule and the barrel must be composed of the same, or at least compatible, plastic materials to assure that a contiguous, permanent and leak-proof weld is obtained in the contiguous surfaces of the parts. Generally, the plastic materials must be identical. However, different plastic materials are sometimes necessary for use with different types of inks. Each ferrule and barrel of the differing plastic, being identically formed, are sometimes indeterminable as to composition. If an inadvertent attempt is made to weld a ferrule of one plastic material to a barrel of a different plastic material, the fusing of the contiguous surfaces may be incomplete or wholly defective. This flaw is not necessarily apparent from visual inspection. Thus, for instance, in removing the cap from a finished instrument, the ferrule may become disengaged from the barrel resulting in leakage or spillage of the ink from the fluid reservoir upon the person using the writing instrument.

Even with plastic materials which are compatible for the spin welding technique, this same type of flaw may occur if the surface tolerances between the parts is too great. Again, due to incomplete fusing of the contiguous surfaces of the ferrule and the barrel, evaporation of the volatile solvent in the marking fluid may occur, the parts may become disengaged, or leakage of the writing fluid may result.

Ultrasonic welding procedures suffer from the same infirmities found in the spin welding technique. Chemical bonding or adhesive methods for joining the components are time consuming and uneconomical, in addition to having the problems incurred in maintaining proper alignment in the assembly operation. An adhesive must be compatible with differing materials if inadvertent mixing of different plastic components occurs, or if differing plastics are intentionally used. Application of adhesive material is difficult, and an excess of adhesive material applied can result in its oozing around the exterior of the connecting joint, making an unsightly, and possibly unsatisfactory, writing instrument housing.

In the techniques of spin welding, of electric ultrasonic welding and of chemical bonding, the equipment generally used, because of its complexity, requires considerable maintenance which often results in interruptions in the automated assembly operation. Such interruptions for maintenance causes production losses and increased costs.

SUMMARY OF THE INVENTION

It is an object of the present invention to provide a solution for one or more of the problems set forth above.

According to the present invention, a housing assembly for a writing instrument is disclosed and comprises a hollow, cylindrically shaped barrel, and a ferrule having a cylindrically shaped skirt portion complementary to and engageable with an adjacent barrel skirt portion to provide an inner chamber for a reservoir holding marking fluid. The barrel skirt portion and the ferrule skirt portion have complementary sets of opposed, axially opening notches positioned for interfitting engagement to prevent relative rotation between the ferrule and barrel when the skirt portions are fully seated in telescoping relation. The skirt portions are also provided with latch means cooperating to maintain the sets of notches in interfitting engagement, the latch means being resiliently engageable when the skirt portions are moved into telescoping relation. Each latching element of the latch means has an annular sealing surface which are positioned for intimate peripheral contact when the latching elements are in latching position to afford a seal preventing egress of marking fluid from the reservoir and preventing evaporation of the volatile solvent of the marking fluid. In the preferred embodiment, two pairs of such latching elements and two pairs of such sealing surfaces are utilized.

Thus, the housing assembly of the writing instrument may be quickly and securely assembled by a press fitting operation utilizing an air cylinder in which the ferrule skirt portion is moved longitudinally into contiguous engagement with the complementary skirt portion of the barrel. The barrel and ferrule can each be easily and readily manufactured by common plastic molding techniques with appropriate tolerances between the interfitting and telescoping parts. At least one of the ferrule member and the barrel member is composed of a material and properly designed to be slightly resiliently flexible. Preferably, both members are so formed, and each member has an elastic memory of shape such that it tends to recapture its originally molded form.

In forming a ferrule and barrel assembly, the foregoing invention further eliminates the need for spin welding, or similar assembling methods heretofore used to prevent relative rotation between component parts, and yet provides effective latching means and sealing means between such component parts to prevent leakage and inadvertent separation.

Other objects and advantages of this invention will be apparent from the following detailed description, the drawings, and the appended claims.

DETAILED DESCRIPTION OF THE INVENTION

Figures 1, 2, 3:
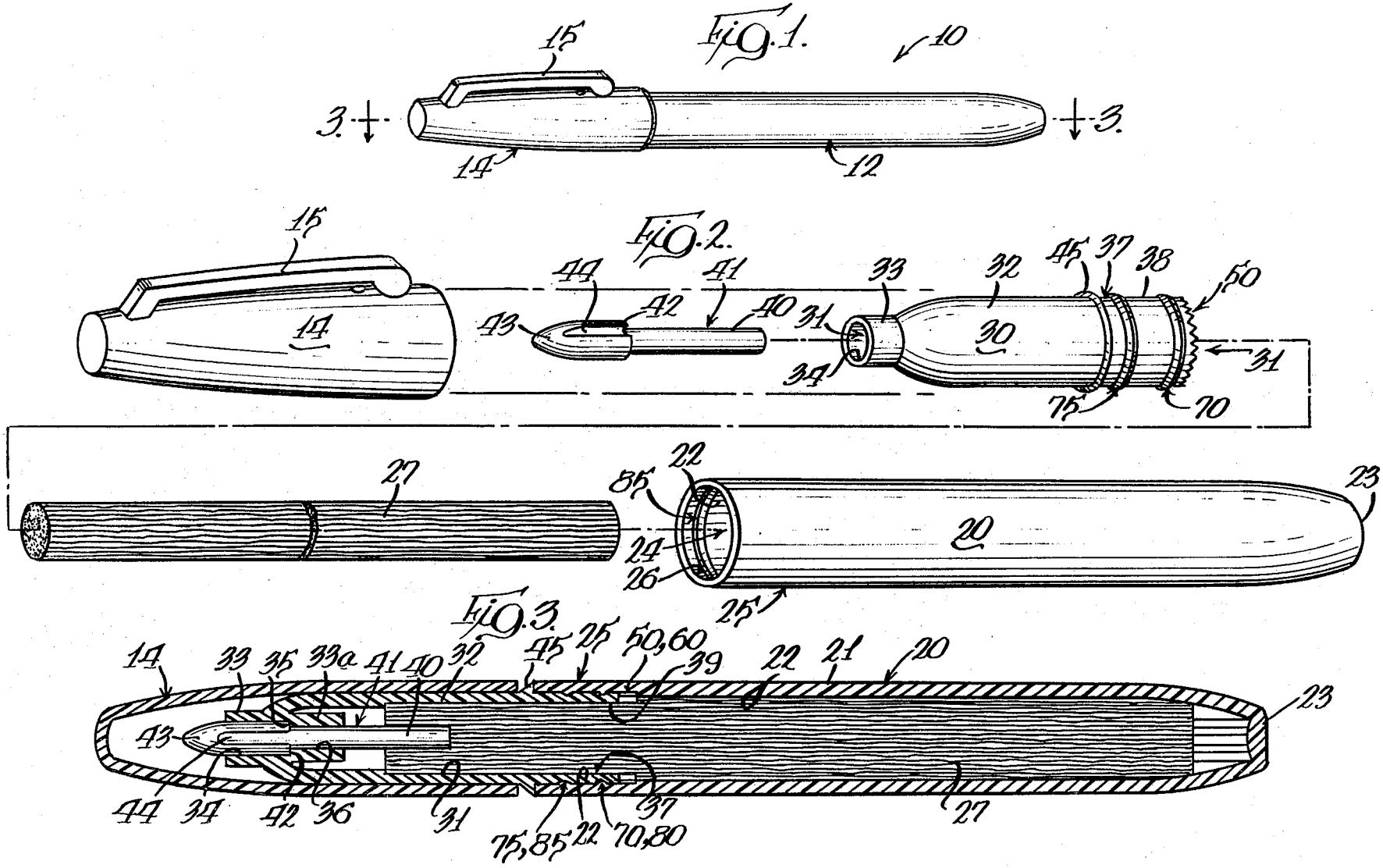
FIG. 1 is a side perspective view of a writing instrument made according to the invention.
FIG. 2 is an enlarged, exploded perspective view of the writing instrument of FIG. 1.
FIG. 3 is an enlarged sectional view of the writing instrument of FIG. 1 taken generally along line 3—3 of FIG. 1.

FIGS. 1–3 illustrate a writing instrument, generally designated 10, made according to the invention. The instrument 10 generally comprises a body or housing assembly 12 and a cap 14 of such a size to frictionally engage the writing end of the housing 12 when the writing instrument is not in use. A conventional clip 15 is provided on the cap 14.

The housing 12 comprises an elongate, hollow, cylindrically shaped, barrel member generally designated 20 and a ferrule member, generally designated 30. The barrel member is formed by a cylindrically shaped wall 21, preferably circular in cross section, which has a similar cylindrically shaped inner surface 22, closed at its rearward distal end 23, forming an inner chamber 24. The forward end of the barrel 20 has a barrel skirt portion, generally designated 25, which is circularly shaped in cross section and has a forwardly opening end 26. The inner chamber 24 of the barrel is intended to hold a loosely fitting writing fluid reservoir 27 which is formed from an elongate generally cylindrical bundle of porous fibrous material, such as cellulose fibers. This fluid reservoir 27 retains and stores a quantity of writing fluid, usually injected into the fibrous material.

The ferrule 30 has a longitudinal cylindrically shaped passageway 31 extending therethrough which is formed by a cylindrically shaped body portion 32. A small cylindrical nib holder 33 is formed forwardly of the body portion 32 and is shaped to provide a bore 34 of such a size to closely receive a writing head 43 of a porous capillary writing nib 41. The inner surface of the nib holder 33 is provided with an annular abutment 35 spaced inwardly of the bore 34 to engage a shoulder 42 of the nib 41 and limit inward movement of the nib 41 into the nib holder 33. The nib holder 33 is also provided with an embracing portion **33*a* shaped to afford a smaller counterbore 36 extending rearwardly of the abutment 35 to frictionally embrace a rearward cylindrical shank portion 40 of the nib 41 so as to hold the writing head 43** in operative position.

A ferrule skirt portion, generally designated 37, is formed on the rearward end portion of the ferrule 30. The ferrule skirt portion 37 is generally circular in cross section to afford an outer lateral surface 38 and terminates with an opening 39 in the rear end of the ferrule 30. The barrel 20 and the ferrule 30 are preferably formed of a resiliently flexible material, such as polypropylene, nylon or similar plastic materials.

During a writing operation, as best seen in FIG. 3, writing fluid passes by capillary action from the reservoir 27 to the capillaries of the rearward shank portion 40 embedded in the reservoir 27 and then forwardly through the shank 40 to the writing head 43 which is exposed forwardly of the nib holder 33. In order to provide access of ambient air pressure throughout the length of the inner chamber 24 of the barrel to assure pressure equalization therein, a groove or depression 44 is formed in the nib 41 to afford an air passage leading through the nib holder 33 of the ferrule 30 to the inner chamber 24 of the barrel 20.

The adjacent skirt portions, 25 on the barrel and 37 on the ferrule, are each of a size to fit one within the other when the barrel 20 and ferrule 30 are moved longitudinally toward each other into contiguous engagement, and the interfitting of the two skirt portions mechanically fastens the ferrule 30 to the barrel 20 and securely constrains the ferrule 30 against relative axial rotation with respect to the barrel 20 at all times. This feature not only provides a quick and easy press fit assembly, but it also assures that the ferrule 30 will not become disengaged from the barrel 20 inadvertently if the cap 14 is twisted in removing the cap from the writing instrument housing assembly.

As herein shown in the preferred embodiment, the skirt portion 37 of the ferrule is inserted into the skirt portion 25 of the barrel 20 with inward movement of the ferrule limited by a transverse projecting annular shoulder 45 on the skirt portion 37 which is brought into abutment with the forward end of the barrel 20.

Figure 4:
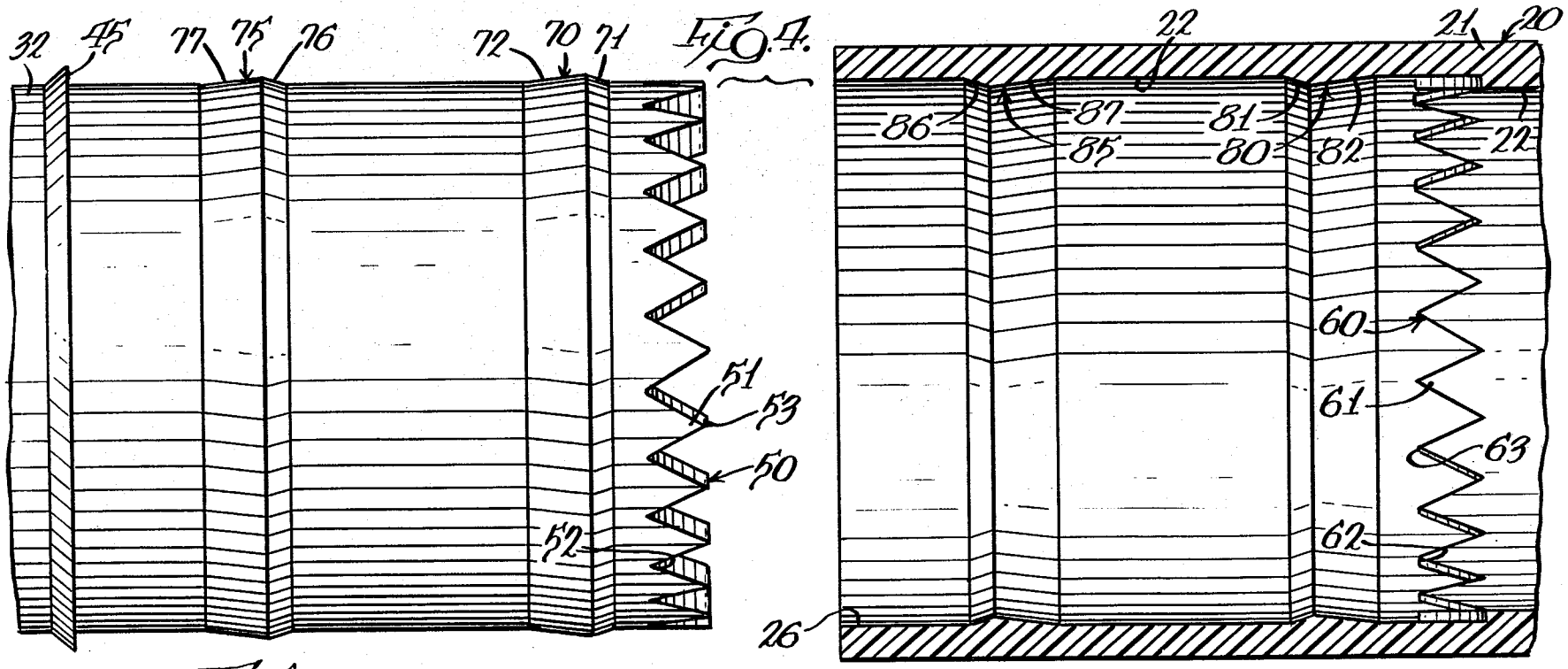
FIG. 4 is an enlarged, exploded, broken view, partly in section, of a portion of the ferrule member and barrel member of the writing instrument of FIGS. 1–3.

The housing assembly of the writing instrument is provided with means to prevent relative axial rotation between the assembled barrel 20 and ferrule 30. As herein shown, this means for preventing relative axial rotation includes a first set of axially opening notches 50 positioned peripherally of the inner end of the ferrule skirt portion 37, and a second set of complementary axially opening notches 60 positioned in opposed relation and peripherally depending inwardly from the inner surface 22 of the barrel skirt portion 25 as shown in FIG. 4. The notches 50, 60 of each set are each formed between a pair of adjacent apex portions 51, 61, and each apex portion is preferably of the same size and shape to afford similarly sized notches in each of the sets. Thus the notches 50 and apex portions 51 of the first set are complementary to the notches 60 and apex portions 61 of the second set so that the opposed notches and apex portions mate or nest in interfitting engagement when the ferrule skirt portion 37 is moved longitudinally into the barrel skirt portion 25 to a fully seated, telescoping position. The second set of notches 60 is preferably spaced inwardly and rearwardly of the open end 26 of the barrel skirt portion 25. Preferably, there are approximately twenty-four (24) notches in each set so that the notches are spaced apart by 15° at their respective roots 52, 62 and their crests 53, 63.

Because of the angular apex portions 51, 61, the notches and apex portions of each set are guided automatically by the projecting crests 53, 63 into self-centering interfitting engagement when the ferrule skirt portion 37 is moved longitudinally into fully seated position within the barrel skirt portion 25.

Figure 5:
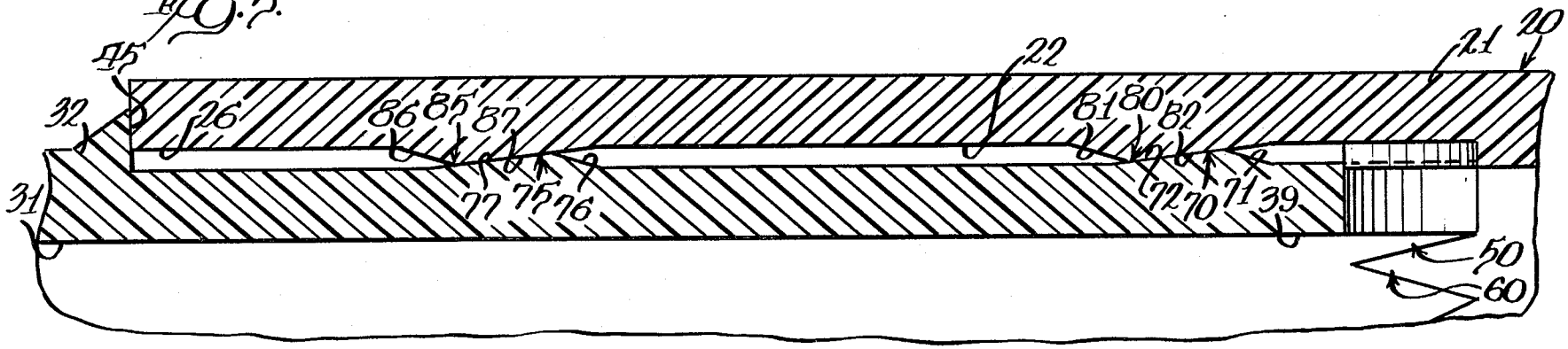
FIG. 5 is an enlarged, fragmentary, longitudinal, sectional view of a portion of the writing instrument of FIG. 3 with the ferrule member and barrel member in fully seated, telescoped relation.

As here shown in FIG. 4 and FIG. 5, latch means, resiliently engageable in latched position, are provided on the inner and outer surfaces of the skirt portions 25, 37 for retaining the complementary sets of notches 50, 60 in interfitting engagement when the skirt portions are in fully seated and telescoped position.

The latch means preferably is formed from a pair of integral, ring-like, annular elements 70, 80, one annular latching element 70 extending outwardly of the outer surface 38 of the ferrule skirt portion 37, and the other annular latching element 80 extending inwardly of the inner surface 22 of the barrel skirt portion 25. The latching elements 70, 80 are of a size to make interferring contact with each other when the ferrule skirt portion 37 is moved longitudinally into the barrel skirt portion 25.

The latching element 70 is preferably provided with an annular cam surface 71 and a trailing annular tapered surface 72. The tapered surface 72 preferably is in the shape of the lateral surface of a truncated right circular cone. Referring to the barrel skirt portion 25, the latching element 80 is also preferably provided with an annular cam surface 81 and an annular tapered surface 82 shaped to engage complementarily the tapered surface 72 on the ferrule.

The ring-like latching member 70 is also slightly over-size with respect to the inner diameter of the barrel skirt portion 25 so that the resilient material in each of the walls forming the skirt portions 25, 37 is resiliently deformed by the ring member 70 as the ferrule skirt portion 37 is telescoped into barrel skirt portion 25. Thus the resilient materials forming each annular wall of the skirt portions 25, 37 are normally urged toward each other when the skirt portions are in fully telescoped relationship.

A second pair of annular elements, namely latching elements 75, 85, similar in structure and function to the first pair of latching elements 70, 80, are preferably provided on the skirt portions 37 and 25, respectively. The latching element 75 is shaped to provide an annular cam surface 76 and a trailing annular tapered surface 77; and the latching element 85 is shaped to provide an annular cam surface 86 and an annular tapered surface 87. Preferably the outer diameter of latching element 75 is slightly less than the outer diameter of latching element 70, and the inner diameter of latching element 85 is slightly greater than the inner diameter of latching element 80, for reasons which will subsequently be made apparent.

Thus when the skirt portion 37 is pressed inwardly of skirt portion 25, latching element 70 rides past barrel latching element 85 caused by deflecting engagement between cam surface 71 and cam surface 86; and as ferrule notches 50 and apex portions 51 move into interfitting engagement with barrel notches 60 and apex portions 61, cam surfaces 71, 81 engage and resiliently deform the walls of skirt portions 37, 25 to permit annular latching element 70 to ride past barrel latching element 80 so that tapered surfaces 72, 82 are brought into engagement, as shown in FIG. 5. The deflected or deformed walls of skirt portions 37, 25 each tend to seek its original shape and each urges the tapered surfaces 72, 82 toward each other so that the ferrule latching element 70 is captured and retained in latching position by the barrel latching element 80 with the notches and apex portions in interfitting engagement. Because of the angled relation between the tapered surfaces 72, 82 a vector force is created urging the ferrule member 30 toward the barrel member 20 to retain the skirt portions 37, 25 in telescoped and fully seated position.

In the preferred embodiment, as the skirt portions 37, 25 become fully seated, the tapered surfaces 77, 87 of the second pair of latching elements 75, 85 are brought into resilient engagement in the same manner as described above in respect to latching elements 70, 80 to provide a second or auxiliary engaging latch means.

Since the marking fluid has a low viscosity and will move through small capillary passages such as in the nib 41 and the fibrous reservoir 27, the adjacent skirt portions 25, 37 when assembled must maintain an effective sealing means to prevent evaporation of volatile writing fluid solvent and to prevent the egress of marking fluid between the surfaces of the adjacent skirt portions 25, 37. The sealing means herein is afforded by the intimate resilient engagement between tapered surfaces 72, 82 and 77, 87. These pairs of tapered surfaces are pressed together throughout a substantial annular area, as shown in FIG. 5, by the resiliently deflected walls of the adjacent skirt portions 37, 25 to provide a particularly effective seal.

As pointed out earlier, preferably tolerances are maintained between tapered surfaces 72, 82 and 77, 87 so that the tightest and most effective seal is made between the innermost tapered surfaces 72, 82 which provide sealing action most nearly adjacent to the writing fluid in the reservoir. A secondary, auxiliary seal is provided between tapered surfaces 77, 87 of the second pair of annular latching elements 75, 85.

While the writing instrument herein may be constructed with a single pair of latching elements 70, 80, it is preferred to use the additional pair of latching elements 75, 85 which add stability and strength to the fastening function. In other words, with dual latching, the ferrule cannot be rocked or angularly moved with respect to the axis of the barrel to disengage the adjacent skirt portions 25, 37 as may be possible if a single latch means is employed.

The structure of the present invention accomplishes a number of important functions in a writing instrument with a simple press fit assembly operation. It secures the ferrule against relative axial rotation with respect to the barrel; it provides an effective mechanical fastening of the ferrule to the barrel; it provides an effective seal between adjacent parts of the ferrule and the barrel; and it causes the ferrule and barrel to be normally urged toward each other when assembled. Additionally, it allows the barrel 20 and the ferrule 30 to be made of different plastic materials as may be desired in some cases. The invention provides for quick assembly of readily moldable parts to facilitate mass production of writing instruments, and its structure preserves an attractive and uniform outside appearance of each instrument. Importantly also, it eliminates untimely accidents in which writing fluid is spilled when the ferrule and barrel become disconnected in an occasionally defectively made writing instrument.

While the invention is especially suitable for use in forming a barrel and ferrule into a housing assembly for a writing instrument, it is also well suited for use in other dual component assemblies requiring complementary engagement between two cylindrically shaped bodies.

The foregoing description is given for clearness of understanding only and no unnecessary limitations should be implied therefrom, as modifications will be obvious to those skilled in the art.

I claim:

1. In a writing instrument of the type having a reservoir for marking fluid and a writing nib for carrying marking fluid from the reservoir to a surface to be marked, a housing assembly for the writing instrument, comprising:

an elongate hollow barrel member having an inner chamber to receive the reservoir, the barrel member having a closed rear distal end;

a ferrule member positioned in longitudinal alignment forwardly of the barrel member, the ferrule member having a passageway therethrough and a free end shaped to snugly receive the writing nib, at least one of said barrel and ferrule members being of resilient material;

adjacent skirt portions of circular cross section on the barrel member and the ferrule member for securing the ferrule member against relative axial rotation with respect to the barrel member, the skirt portions having open end portions and being of a size to make a close mating fit one within the other when moved longitudinally toward each other, the one skirt portion having an outer annular surface and a first set of axially opening notches about its periphery, and the other skirt portion having an inner annular surface and being provided with a second set of complementary axially opening notches positioned in opposed relation to said first set of notches, said sets of notches being positioned for interfitting engagement to prevent said relative axial rotation when the one skirt portion is moved longitudinally into the other skirt portion; and preformed latch means on the inner and outer surfaces of the skirt portions for retaining the sets of complementary notches in interfitting engagement.

2. A housing assembly as specified in claim 1, in which the skirt portion of the ferrule member is of a size to make a close mating fit within the skirt portion of the barrel member.

3. A housing assembly as specified in claim 2, in which the first set of notches is formed peripherally of the open end portion of the ferrule skirt portion.

4. A housing assembly as specified in claim 3, in which the second set of notches is formed inwardly of the open end portion of the barrel skirt portion and peripherally of the inner annular surface.

5. A housing assembly as specified in claim 2, in which the latch means includes a first annular element extending outwardly of the outer surface of the ferrule skirt portion and a second annular element extending inwardly of the inner surface of the barrel skirt portion, the annular elements making interferring contact when the skirt portions are telescoped with each other, the annular elements deflecting the resilient material to permit the first annular element to move inwardly past the second annular element into latching position when the sets of notches are moved into interfitting engagement.

6. A housing assembly as specified in claim 5, in which each of the annular elements is provided with a circular sealing surface, the sealing surfaces being positioned in intimate peripheral contact when the annular elements are in latching position to prevent egress of marking fluid from the reservoir.

7. A housing assembly as specified in claim 1, in which the notches of each set are of the same size and shape.

8. A housing assembly as specified in claim 1, in which apex portions are provided between adjacent notches of each set to guide the sets of notches into self-centering interfitting engagement when the one skirt portion is moved longitudinally into the other skirt portion.

* * * * *